US009752829B2

(12) United States Patent
Brahmbhatt

(10) Patent No.: US 9,752,829 B2
(45) Date of Patent: Sep. 5, 2017

(54) LIQUID NITROGEN (LIN) INTEGRATED LYOPHILIZATION SYSTEM FOR MINIMIZING A CARBON FOOTPRINT

(71) Applicant: Sudhir R. Brahmbhatt, Glencoe, MO (US)

(72) Inventor: Sudhir R. Brahmbhatt, Glencoe, MO (US)

( * ) Notice: Subject to any disclaimer, the term of this patent is extended or adjusted under 35 U.S.C. 154(b) by 397 days.

(21) Appl. No.: 14/490,006

(22) Filed: Sep. 18, 2014

(65) Prior Publication Data

US 2015/0192359 A1 Jul. 9, 2015

Related U.S. Application Data

(60) Provisional application No. 61/924,471, filed on Jan. 7, 2014.

(51) Int. Cl.
*F26B 5/06* (2006.01)

(52) U.S. Cl.
CPC ..... *F26B 5/06* (2013.01)

(58) Field of Classification Search
CPC ..... F26B 5/06
See application file for complete search history.

(56) References Cited

U.S. PATENT DOCUMENTS 4,856,285 A * 8/1989 Acharya ..... F25D 16/00 62/332
6,960,464 B2 * 11/2005 Jessee ..... A01N 1/02 424/93.4

OTHER PUBLICATIONS

Freeze Drying / Lyophilization from the Laboratory to Production webpage; Dec. 12, 2014 (3 pages); Millrock Technology, Inc.
Production Freeze Dryers / Taking Freeze Drying to the Next Level webpage; Dec. 12, 2014 (3 pages); Millrock Technology, Inc.
Small Batch Contract Freeze Drying Services (Contract Lyo Service) webpage; Dec. 12, 2014 (2 pages); Millrock Technology, Inc.
Revo® Series Freeze Dryers (Development Freeze-Dryer Lyophilizer) webpage; Dec. 12, 2014 (4 pages); Millrock Technology, Inc.
Yanisko, et al.; "Use Nitrogen Safely"; CEP; Mar. 2012 (pp. 44-49); Air Products and Chemicals, Inc.
(Continued)

*Primary Examiner* — Jessica Yuen
(74) *Attorney, Agent, or Firm* — William H. Eilberg

(57) ABSTRACT

A process and system for lyophilizing a product. The product is first cooled in a cooling chamber (12) and then passed through a liquid nitrogen bath (14) where it is frozen. It is then freeze dried in a lyophilization chamber (26) during which the water or non-aqueous media is sublimated using a combination of gaseous nitrogen and vaporized nitrogen from liquid nitrogen supplied to the lyophilization chamber. Water and non-aqueous media removed from the product during sublimation is purged from the chamber. The system of the present invention provides more energy efficient operation, eliminates the use of hot oils and oil leaks, operates more reliably, and the liquid nitrogen can be used both as a refrigeration source, for heating shelves instead of hot oil and also can maintain the lyophilization temperature in case of power failure with minimum electric power supply in case of a power outage.

7 Claims, 1 Drawing Sheet

(56) References Cited

OTHER PUBLICATIONS

"Gas solutions for the biotechnology and life science industries . . . "; 2012 (4 pages); vol. 312-12-045-US; Air Products and Chemicals, Inc.
Lyophilization Technology course on Apr. 28-29, 2015 webpage; Dec. 12, 2014 (2 pages); CfPA (The Center for Professional Advancement).
"Freeze-drying"; Wikipedia® webpage; Dec. 12, 2014 (7 pages); Wikimedia Foundation, Inc.
Hunek, et al; "Increasing Lyophilization Productivity, Flexibility, and Reliability Using Liquid Nitrogren Refrigeration—Part 1" webpage; BioPharm International; Oct. 31, 2007 (4 pages); Advanstar Communications, Inc.
Hunek, et al; "Increasing Lyophilization Productivity, Flexibility, and Reliability Using Liquid Nitrogren Refrigeration—Part 2" webpage; BioPharm International; Dec. 1, 2007 (4 pages); Advanstar Communications, Inc.
Yglesias, et al; "Evaluation of Liquid Nitrogren Freeze Drying and Ethanol Dehydration as Methods to Preserve Partially Cooked Starch and Masa Systems"; Cereal Chemistry; Received Mar. 18, 2005 / Accepted Jun. 21, 2005 (pp. 701-705); vol. 82, No. 6; University of Nebraska—Lincoln.
Freeze Drying and Freeze dried foods webpage; Dec. 12, 2014 (2 pages); Pinterest.
A.J. Andrews; "How to Use Nitrogen to Freeze Dry Food" eHow webpage; Dec. 12, 2014 (4 pages); Demand Media, Inc.
"Home Freeze Dryer (Lyophilizer) . . . can it be done?" Instructables webpage; Dec. 12, 2014 webpage dating from 2009-2014 (4 pages); Autodesk, Inc.
Dr Alan Cheng, Ph.D.; "Advances in Liquid Nitrogren Based Lyophilization Technologies" webinar; May 21, 2013 (1 page); SP Scientific.

* cited by examiner

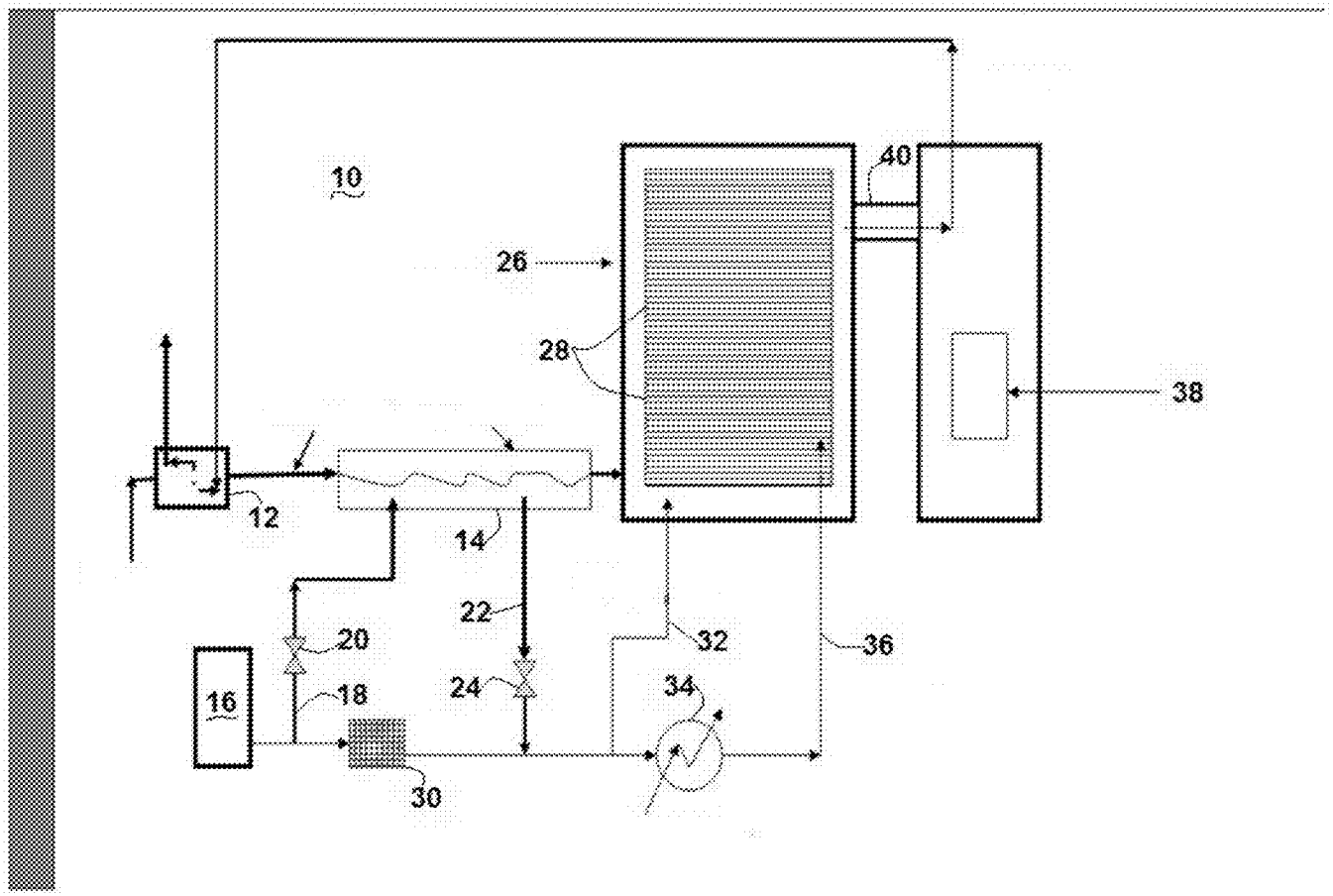
38
40
36
32
34
28
26
14
22
24
30
10
20
18
12
16

LIQUID NITROGEN (LIN) INTEGRATED LYOPHILIZATION SYSTEM FOR MINIMIZING A CARBON FOOTPRINT

CROSS REFERENCE TO RELATED APPLICATIONS

This application is based on and claims the benefit of provisional patent application 61/924,471 filed Jan. 7, 2014.

STATEMENT REGARDING FEDERALLY SPONSORED RESEARCH

N/A

BACKGROUND OF THE INVENTION

This invention is directed to minimization of a carbon footprint created during the operation of a lyophilization system used in the pharmaceutical industry, or in the food industry, by i) reducing the use of chlorofluorocarbons, and ii) significantly reducing the use of rotating equipment and the consequent use of electricity.

Biologically active products including pharmaceuticals such as vitamins, hormones, tranquilizers and antibiotics; proteins such as enzymes and gelatins; and control products such as plasma or serum are in wide spread use. Despite this fact, there are still many problems with the way in which they are produced and the form in which they are provided. For example, since they are biologically active, they should be provided in a form which will preserve their biological activity for a reasonable time. One method of doing this is to freeze the substance and retain it in its frozen state. However, this entails extra handling and equipment necessary to keep the substance frozen at all times.

Alternatively, quantities of a substance are frozen in bulk form and subsequently lyophilized. By doing so, the product no longer has to be maintained at temperatures below freezing, but the slow freezing that takes place during bulk freezing creates other problems. For example, slow freezing promotes the development of concentration gradients. Thus, when blood serum or plasma is frozen slowly, cholesterol and triglyceride globules within the serum or plasma are forced to coalesce. These globules, upon dissolution of the lyophilized product in an aqueous solvent, apparently do not re-disperse but remain coalesced, resulting in a non-uniform product.

Another problem is that slow freezing produces degradation of various biological constituents. Freezing of enzyme solutions, for example, generally appears to have a degrading effect on the enzymes. The slow freezing that takes place during bulk freezing and the concentration gradients that build up during this process, increase the degradation which occurs.

One effort to counteract enzyme degradation resulting from slow freezing of a plasma, for example, has been to entirely remove the enzyme and other constituents from the plasma, and add (weigh) in predetermined quantities of these substances so to achieve a constant level of these constituents after the product is frozen and dried. The weight of an enzyme, however, does not truly represent the amount of material that needs to be added. Because enzymes are subject to degradation, the "true" measure of enzyme concentration is activity, for which weight is not an accurate substitution.

Finally, the reconstitution of lyophilized substances by dissolution in water encounters difficulties when the substance is frozen in bulk form. A reconstitution may require from 20-30 minutes and often results in a lack of clarity. This is a particularly bothersome problem with control products, such as serum or plasma, when subsequent photometric analysis is performed on them. Furthermore, when products are frozen in bulk form they are difficult to dispense in any other form but their reconstituted form.

Sometimes fluorocarbon refrigerants may have a higher boiling point than other liquid refrigerants, for example, liquid nitrogen. A higher boiling point, being closer to the temperature of the solution droplets, results in less of a vapor phase barrier between the particle and the refrigerant. This can result in more rapid freezing of the particles than can be achieved with even colder refrigerants such as liquid nitrogen.

Fast freezing also prevents the loss of those constituents of a solution that would otherwise be soluble in a fluorocarbon. Thus, when the product is serum or plasma, for example, negligible loss of cholesterol and triglycerides has been found, even though these are organic compounds soluble in some fluorocarbons. Specifically, with a lower detection limit of 2 to 3 percent (2-3%), no loss of these substances has been found. It will also be noted that the use of liquid nitrogen may sometimes produce less spherical and less uniform sized particles.

Currently, a lyophilization or lyo operation involves placing a product in a lyophilization chamber which is then cooled down until the product is frozen. During the next step of the process, hot oil is used to heat shelves within the chamber on which the product is placed so to sublimate water crystals formed on the product as it freezes.

This operation has a number of drawbacks. First, the entire chamber must be cooled down. Second, the hot oil may leak in the chamber causing both product contamination and clean-up problems. Third, if mechanical refrigeration is used, its maintenance is expensive. Fourth, it is an expensive process particularly for low cost products.

In addition to the above, pharmaceutical, biotechnical and food industries are now attempting to reduce their carbon footprints; and, due to an increased demand for more flexibility in performance because of the aqueous and non-aqueous media in the products they make, only limited alternatives are available. Economic factors and operating expenses are both critical factors in any option being considered.

Liquid nitrogen (LIN) based lyophilization or lyo systems are among the options under consideration, and it is believed that installation of a LIN system is more expensive per kilowatt-hour (kwh) cooling output than the electrical energy needed to produce the same cooling effect in a compressor based system. However, it has been shown that, unlike compressor based refrigeration systems, operating costs of a LIN system are lower such that LIN based systems are more economical over the long run than cooling with compressors.

BRIEF SUMMARY OF THE INVENTION

In the lyophilization system disclosed herein, hot oil currently used is replaced with either hot nitrogen or similar specific heat transfer media, depending on the heat duty requirement of the system. An advantage of this is that it allows a user to minimize the use of rotating parts and eliminates the need of a hot oil transfer system. Another advantage is the elimination of possible oil leaks.

The system of the present invention enables a user to freeze the product being made or processed outside of the system's lyophilization unit thereby eliminating the need to cool down a LYO chamber. The manner in which a product is frozen greatly affects the size and shape of the ice crystals it forms and, hence, the morphology of the final cake and the capacity to remove water from the frozen sample once a vacuum is applied. As the balance between crystal growth and ice nucleation determines the number, shapes, and sizes of ice crystals, the temperature where ice nucleation takes place is an important factor. The biological product is then frozen by either slowly cooling it from the ambient temperature by a gradual reduction in shelf temperature, or rapidly cooling them on a pre-chilled shelf. While some super cooling is observed in both methods, the former treatment leads to more super cooling and results in relatively homogeneous ice crystals. The advantage of having some degree of super cooling is the consistency of product throughout the vials. This consistency includes moisture content, crystallinity of excipients, and distribution of product. In practice, this rapid cooling approach is harder to scale-up as temperature control is more difficult and batch-to-batch variation is greater at larger-scale lyophilization. In addition, loading on pre-chilled shelves leads to frost build-up and can be a challenge with automated loading systems at commercial scale. It has been found that freezing products by immersing in liquid nitrogen can lead to irregularly shaped ice crystals having a very large ice surface area.

A large surface area can improve both the sublimation rate during primary drying and the desorption rate during secondary drying. In addition, an increased ice surface area may affect the stability of some of proteins or biological products. Product to be lyophilized should be tested in small scale and pilot scale freeze dryers to determine the value of freezing temperature.

This new approach, as described hereinafter, offers significant economic benefits by integrating nitrogen use in a lyophilization based system. One advantage of the LIN based system of the present invention involves freezing a lyophilization product prior to putting it into the lyo system. This is advantageous because an operator can now significantly reduce nitrogen use and avoid cooling the entire LYO chamber and freezing the product in the chamber during a manufacturing process. Other technologies such as pelletization, spray crystallization can help provide a larger surface area for the product enabling it to dry faster in a drying step.

Other advantages include a significant reduction in the process carbon footprint, and reduced cycle times which lead to increased throughput.

Other objects and features will be in part apparent and in part pointed out hereinafter.

BRIEF DESCRIPTION OF THE DRAWING

The sole drawing FIGURE is a simplified representation of the operation of the present invention.

DETAILED DESCRIPTION OF INVENTION

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawing, a lyophilization system is indicated generally 10. In performing a lyophilization process, a product to be lyophilized is first introduced into a cooling chamber 12. After the temperature of the product has been lowered to a predetermined temperature, it is routed from cooling chamber room 12 to a bath 14. Bath 14 may, for example, be a tunnel through which a transfer device (e.g., tray or conveyor belt) carrying the product travels to a LYO chamber 26. Liquid nitrogen (LIN) stored in a tank 16 is now directed from the tank to bath 14 through a supply line 18 which includes an appropriate flow control valve 20. Within the controlled environment of bath 14, the product is frozen using the LIN based upon a cooling rate specific to the product. A feature of LIN bath 14 in this freezing step is that it ensures optimum use of nitrogen and precooling of the product with the cold nitrogen generated in the LIN bath.

As the LIN converts from liquid to a gas, the gaseous nitrogen GAN is drawn off through a flow line 22 which includes a flow control valve 24.

After the product in bath 14 is frozen, it is delivered from the bath into a jacketed LYO chamber 26 where it is deposited on shelves or racks 28 for further processing. In addition to routing of LIN from tank 16 to bath 14 via line 18, a portion of the LIN is passed through a vaporizer 30 connected in parallel with line 18. The vaporizer converts LIN passing through it to a nitrogen gas. The nitrogen gas is then combined with the GAN drawn from bath 14 through line 22. One portion of the combined gaseous nitrogen and GAN is routed through a flow line 32 into LYO chamber 26 where it is used to blanket the frozen product on the shelves or racks. That is, chamber 26 is purged by the GAN.

A subsequent, sublimation step is now performed within chamber 26 for removal of water or non-aqueous media from the product. For this purpose, gaseous nitrogen drawn from LIN tank 16 is heated, using a heat exchanger 34, to a desired temperature, introduced into the chamber through a flow line 36, and supplied to the shelves or racks 28 within the chamber on which the product is stored. The heated GAN raises the temperature within chamber 26 to a level at which water and any non-aqueous media vaporizes and is drawn off and purged or exhausted from the chamber. This is accomplished using a vacuum pump 38 connected to the chamber by a duct or manifold 40.

The result of this process is to eliminate the use of hot oil and associated equipment needed to remove water or non-aqueous media from the product. Doing so impacts the carbon footprint of the process.

In addition, the system of the present invention offers the following benefits:

more energy efficient operation;

no oil leak issues;

more reliable operation as load is safer and not dependent on the power outage; and LIN is used as refrigeration source and also as a back-up in case of a power outage.

In view of the above, it will be seen that the several objects and advantages of the present disclosure have been achieved and other advantageous results have been obtained.

I claim:

1. A method of lyophilization or freeze drying of products comprising:

placing a product in a cooling chamber to reduce the product's temperature to a predetermined value;

transporting the product from the cooling chamber to a lyophilization chamber through a liquid nitrogen bath having a controlled environment, the product being frozen as it is transported through the bath; and, storing the frozen product in the lyophilization chamber and sublimating the stored product to remove water and non-aqueous media from it, the use of liquid nitrogen in the bath reducing the overall carbon footprint of the method, further including:

providing liquid nitrogen to the bath from a source thereof;

heating of the liquid nitrogen during freezing of the product to produce gaseous nitrogen and drawing off the gaseous nitrogen from the bath;

vaporizing the liquid nitrogen and combining the gaseous nitrogen and vaporized liquid nitrogen; and, supplying the combined gaseous nitrogen and vaporized liquid nitrogen to the lyophilization chamber.

2. The method of claim 1 further including:

supplying a portion of the combined gaseous nitrogen and vaporized liquid nitrogen to the lyophilization chamber to blanket the product stored therein;

supplying another portion of the combined gaseous nitrogen and vaporized liquid nitrogen through a heat exchanger to raise the temperature of the combined gaseous nitrogen to a desired temperature; and, introducing said another portion of the combined gaseous nitrogen and vaporized liquid nitrogen into the lyophilization chamber to sublimate the product.

3. The method of claim 2 further including purging the lyophilization chamber of the combined gaseous nitrogen and vaporized Liquid nitrogen and the water and non-aqueous media removed from the product during sublimation.

4. The method of claim 3, further comprising using a purging means to further heat exhaust gases when passed through the cooling chamber during initial cooling of the product from the cooling chamber.

5. The method of claim 1 further including:

providing liquid nitrogen to the bath from a source thereof;

vaporizing a portion of the liquid nitrogen from said source to produce a gas, and combining said gas with gaseous nitrogen drawn off from the bath, providing a combination of said nitrogen gas and said gaseous nitrogen drawn off from the bath to the lyophilization chamber for performing sublimation of the product.

6. The method of claim 1, further comprising:

providing liquid nitrogen to the bath from a source thereof;

vaporizing a portion of the liquid nitrogen from said source to produce a gas, and combining said gas with gaseous nitrogen drawn off from the bath, supplying a portion of the combined gaseous nitrogen and liquid nitrogen to the lyophilization chamber to blanket the product stored therein, and passing another portion of the combined gaseous nitrogen and liquid nitrogen through a heat exchanger so as to raise a temperature of the combined gaseous nitrogen and liquid nitrogen to a desired level prior to introducing the combined gaseous nitrogen and liquid nitrogen into the lyophilization chamber, wherein said heated portion of the combined gaseous nitrogen and liquid nitrogen causes sublimation of the product.

7. The method of claim 6, wherein the lyophilization chamber includes shelving means on which the product is placed upon introduction into the chamber from the bath, and wherein the method includes blanketing the product stored on the shelving means with a portion of the combined gaseous nitrogen and liquid nitrogen, and applying a heated portion of the combined gaseous nitrogen and vaporized liquid nitrogen supplied to the lyophilization chamber to effect sublimation of the product.

* * * * *